US010561293B2

(12) United States Patent
Dai

(10) Patent No.: US 10,561,293 B2
(45) Date of Patent: Feb. 18, 2020

(54) SQUEEZING AND CLEANING FLAT MOP BUCKET

(71) Applicant: NINGBO CHANGLE COMMODITY CO., LTD, Ningbo, Zhejiang Province (CN)

(72) Inventor: Fangjun Dai, Ningbo (CN)

(73) Assignee: NINGBO CHANGLE COMMODITY CO., LTD, Ningbo, Zhejiang Province (CN)

( * ) Notice: Subject to any disclaimer, the term of this patent is extended or adjusted under 35 U.S.C. 154(b) by 94 days.

(21) Appl. No.: 15/975,027

(22) Filed: May 9, 2018

(65) Prior Publication Data

US 2019/0274516 A1 Sep. 12, 2019

(30) Foreign Application Priority Data

Mar. 9, 2018 (CN) ..... 2018 2 0326211 U

(51) Int. Cl.
*A47L 13/256* (2006.01)
*A47L 13/60* (2006.01)
*A47L 13/58* (2006.01)

(52) U.S. Cl.
CPC ..... *A47L 13/60* (2013.01); *A47L 13/256* (2013.01); *A47L 13/58* (2013.01)

(58) Field of Classification Search
CPC ..... A47L 13/58; A47L 13/256; A47L 13/59
See application file for complete search history.

(56) References Cited

U.S. PATENT DOCUMENTS 8,407,849 B2 * 4/2013 Chen ..... A47L 13/58 15/260
2011/0154607 A1 * 6/2011 Chen ..... A47L 13/58 15/260
2011/0185532 A1 * 8/2011 Lin ..... A47L 13/58 15/260
2012/0047675 A1 * 3/2012 Chu ..... A47L 13/58 15/260
2012/0233803 A1 * 9/2012 Chiang ..... A47L 13/58 15/260

* cited by examiner

*Primary Examiner* — Michael D Jennings
(74) *Attorney, Agent, or Firm* — Charles C. Achkar; Ostrolenk Faber LLP.

(57) ABSTRACT

A squeezing and cleaning flat mop bucket includes a bucket body, a bucket cover and a pressing device. The pressing device is installed at the top of the bucket body, and the bucket cover is covered onto the bucket body. The bucket body has a cleaning chamber, a squeezing chamber, and a partition installed between the cleaning chamber and the squeezing chamber. The pressing device includes a mount having a cleaning port and a squeezing port. The cleaning port has a first squeeze roller; the squeezing port has a second squeeze roller; the first squeeze roller has bumps; and the squeezing chamber contains a pressure pump and a return pipe. The pressure pump is installed at the bottom of the squeezing chamber. The return pipe has an end connected to the pressure pump and the other end disposed at the partition and partially extended into the cleaning chamber.

10 Claims, 4 Drawing Sheets

SQUEEZING AND CLEANING FLAT MOP BUCKET

CROSS REFERENCE TO RELATED APPLICATIONS

The present application claims priority to Chinese Application No. 201820326211.8, filed on Mar. 9, 2018, the subject matter of which is incorporated by reference in its entirety.

FIELD OF INVENTION

The present disclosure relates to the field of cleaning, in particular to a squeezing and cleaning flat mop bucket.

BACKGROUND OF INVENTION

1. Description of the Related Art

Most conventional mop dewatering devices adopt a rotary mop head to squeeze the mop head manually to dewater a mop, but such mop dewatering device is just limited to the use in traditional umbrella mops and not applicable to flat mops.

In general, a conventional flat mop comprises a mop plate and a mop rod, and the mop plate comprises a bottom plate and a mop fabric mounted onto the bottom plate, and the bottom plate is divided into two foldable parts. When it is necessary to dewater the mop fabric, the bottom plate is folded to squeeze the mop fabric. Although this method can dewater the mop fabric, it cannot remove the dirt (such as hair and dust) from the mop fabric. Therefore, it is necessary to remove the mob fabric before rinsing in order to clean the mop fabric thoroughly.

In the meantime, there is a conventional mop bucket which is used for the purpose of cleaning only, but not for dry cleaning. Furthermore, such conventional mop bucket requires an additional manual operation to squeeze the mop in order to dry it. Obviously, the operation is too complicated.

2. Summary of the Invention

Therefore, it is a primary objective of this disclosure to overcome the aforementioned drawback of the conventional mop bucket by providing a squeezing and cleaning flat mop bucket which adopts a roller with bumps. Compared with the mop bucket provided by other manufacturers and simply relying on a scraper to scrap the mop fabric, the mop bucket of this disclosure has the features of high effectiveness and fast drying and cleaning effects. In addition, the dry cleaning bucket has a pressure pump of back-suction function, so that the dry cleaning bucket can be maintained cleaner and it is not necessary to clean the bucket body, and thus the cleaning of bucket can be skipped. In the meantime, a two-stage design is adopted at the cleaning port to provide a more thorough cleaning, wherein a first squeeze roller at the top is provided for squeezing, and the bumps on the surface of the first squeeze roller are provided for scarping garbage, and a first scraping blade at the bottom is provided for re-scraping water and scraping dirt on the mop fabric. A two-stage design is adopted at the squeezing port to squeeze the mop fabric drier and cleaner.

To achieve the aforementioned and other objectives, this disclosure provides a squeezing and cleaning flat mop bucket comprising a bucket body, a bucket cover and a pressing device, characterized in that the pressing device is installed at an upper end of the bucket body, and the bucket cover is covered onto and coupled to the bucket body, and the bucket body has a cleaning chamber, a squeezing chamber therein, and a partition disposed between the cleaning chamber and the squeezing chamber, and the pressing device comprises a mount having a cleaning chamber formed thereon and configured to be corresponsive to a cleaning port and a squeezing chamber configured to be corresponsive to a squeezing port, and a first squeeze roller is mounted onto the cleaning port, and a second squeeze roller is mounted onto the squeezing port, and the first squeeze roller has a plurality of bumps formed thereon, and the squeezing chamber has a pressure pump of back suction function and a return pipe installed therein, and the pressure pump of back suction function is installed to the bottom of the squeezing chamber, and the return pipe has an end coupled to the pressure pump of back suction function and the other end disposed at the partition and partially extended into the cleaning chamber.

Wherein, the cleaning port of the mount has a first positioning wheel, and the squeezing port of the mount has a second positioning wheel.

Wherein, the mount further comprises a backwater board disposed precisely under the second squeeze roller and integrally coupled to the cleaning port with a predetermined tilt angle.

Wherein, the mount further comprises a first scraping blade structure and a second scraping blade structure, and the first scraping blade structure is disposed precisely under the first squeeze roller and contacted and coupled to the backwater board, and the second scraping blade structure is installed precisely under the second squeeze roller.

Wherein, the mount has an elastic buckle disposed at both sides of the mount separately, and the bucket body has an opening formed at an upper end of the bucket body and matched with the elastic buckle, and the mount is coupled to the bucket body through the mutual cooperation of the elastic buckle and the opening.

Wherein, the mount further comprises a handle installed thereon.

Wherein, the bucket cover has a cover plate installed at an end of the bucket cover and disposed at the cleaning chamber and movably coupled to the mount.

Wherein, the cover plate has a connecting member installed on an inner side of the cover plate, and the mount has a rail opening formed thereon and matched with the connecting member, and the cover plate is coupled to the mount through a mutual cooperation of the connecting member and the rail opening.

Wherein, the first scraping blade structure comprises a first scraping blade and a first torsion spring, and the first torsion spring has an end sheathed on the first scraping blade and the other end coupled to the mount.

Wherein, the second scraping blade structure comprises a second scraping blade and a second torsion spring, and the second torsion spring has an end sheathed on the second scraping blade and the other end coupled to the mount.

Compared with the prior art, this disclosure has the following advantages:

1. The squeezing and cleaning flat mop bucket of this disclosure adopts a special roller with bumps to achieve the higher efficiency, faster, and cleaner effects than the conventional mop bucket relying on a scraper to scrap and clean the mop fabric. In addition, the dry cleaning bucket has a pressure pump of back-suction function, so that the dry cleaning bucket can be maintained cleaner and it is not necessary to clean the bucket body, and thus the cleaning of bucket can be skipped, and the cleaning of the bucket is easier.

2. The installation of the first positioning wheel at the cleaning port and the second positioning wheel at the squeezing port facilitates the flat mop to be positioned, cleaned or dry cleaned in the cleaning chamber and the squeezing chamber.

3. The installation of the backwater board onto the mount facilitates recycling extra water produced during the process or squeezing and dewatering the flap mop into the cleaning chamber at the front through the inclined backwater board mounted onto the mount.

4. The cover plate is installed at an end of the bucket cover, disposed in the cleaning chamber, and movably coupled to the mount, so as to facilitate drying the squeezing chamber and preventing the clear water from flowing into the squeezing chamber when filling the clear water into the cleaning chamber.

5. The installation of elastic buckle onto the mount facilitates installing or removing the flat mop bucket.

6. The first scraping blade structure is installed precisely under the first squeeze roller and contacted and coupled to the backwater board. The second scraping blade structure is installed precisely under the second squeeze roller.

A two-stage design is adopted at the cleaning port to provide a more thorough cleaning, wherein a first squeeze roller at the top is provided for squeezing, and the bumps on the surface of the first squeeze roller are provided for scarping garbage, and a first scraping blade at the bottom is provided for re-scraping water and scraping dirt on the mop fabric. A two-stage design is adopted at the squeezing port to squeeze the mop fabric drier and cleaner.

DESCRIPTION OF THE EMBODIMENTS

To understand the technical characteristics of this disclosure intuitively and comprehensively, exemplary embodiments are used and illustrated in referenced figures of the drawings. It is intended that the embodiments and figures disclosed herein are to be considered illustrative rather than restrictive.

Figure 1:
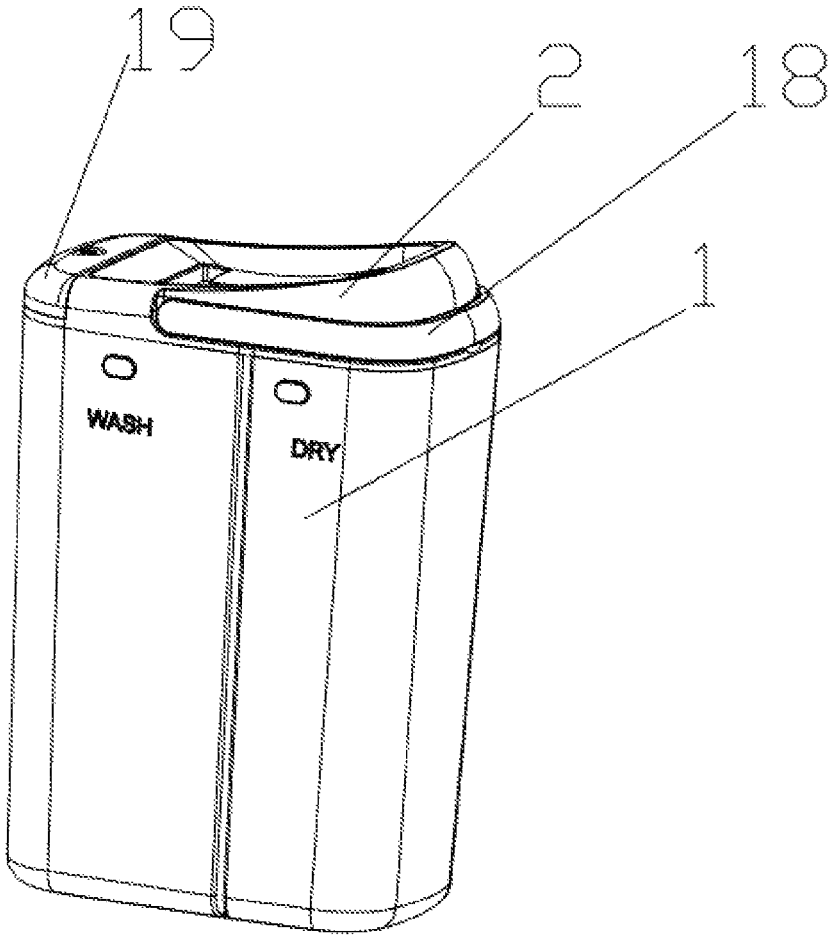
FIG. 1 is a schematic view of the overall structure of a squeezing and cleaning flat mop bucket in accordance with an embodiment of this disclosure.
Figure 2:
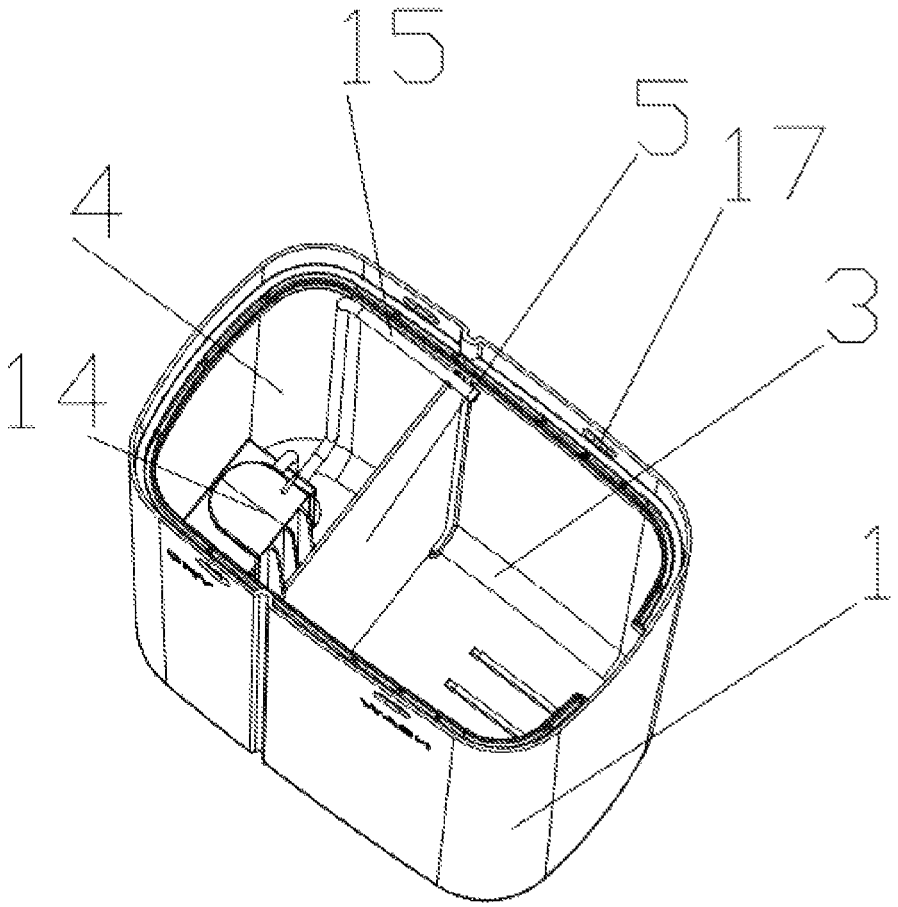
FIG. 2 is a schematic view of the internal structure of a bucket body of a squeezing and cleaning flat mop bucket in accordance with an embodiment of this disclosure.
Figure 3:
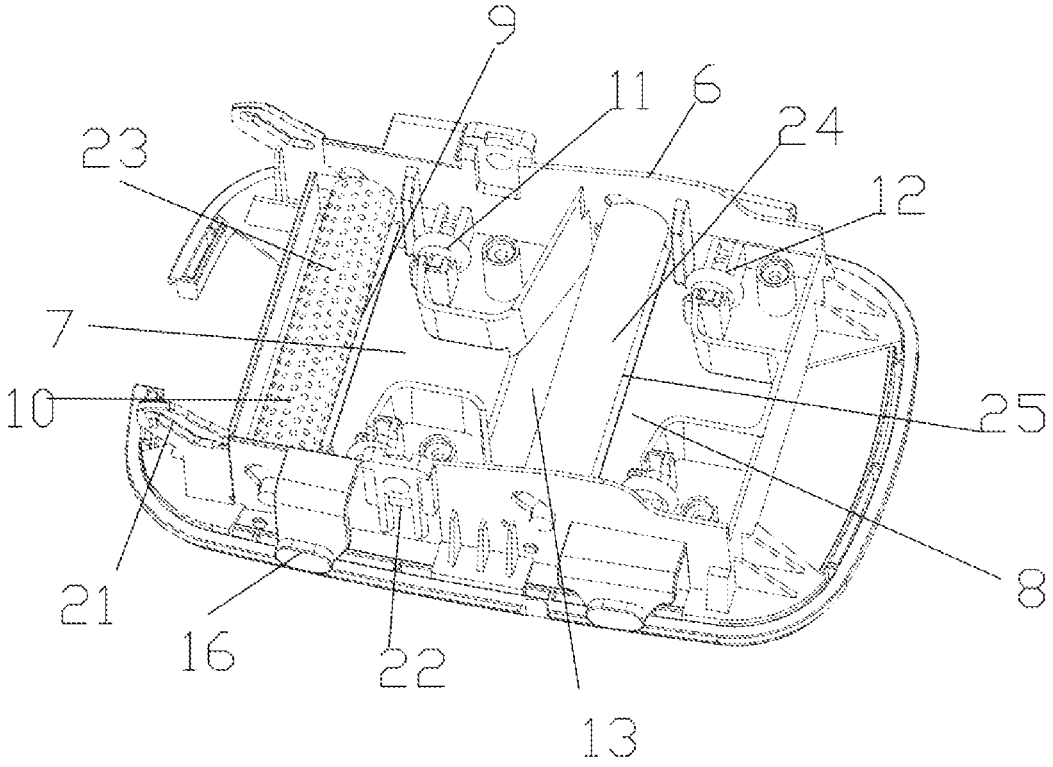
FIG. 3 is a schematic view of the structure of a pressing device of a squeezing and cleaning flat mop bucket in accordance with an embodiment of this disclosure.
Figure 4:
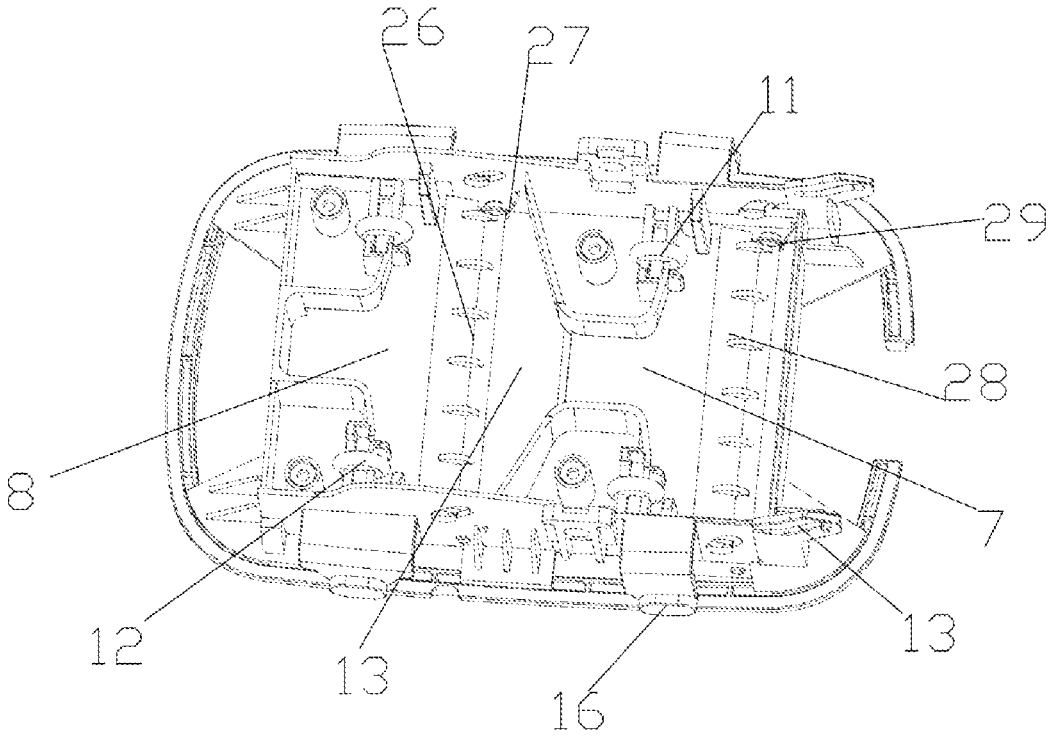
FIG. 4 is a schematic view of a pressing device of a squeezing and cleaning flat mop bucket without having a first squeeze roller and a second squeeze roller in accordance with an embodiment of this disclosure.
Figure 5:
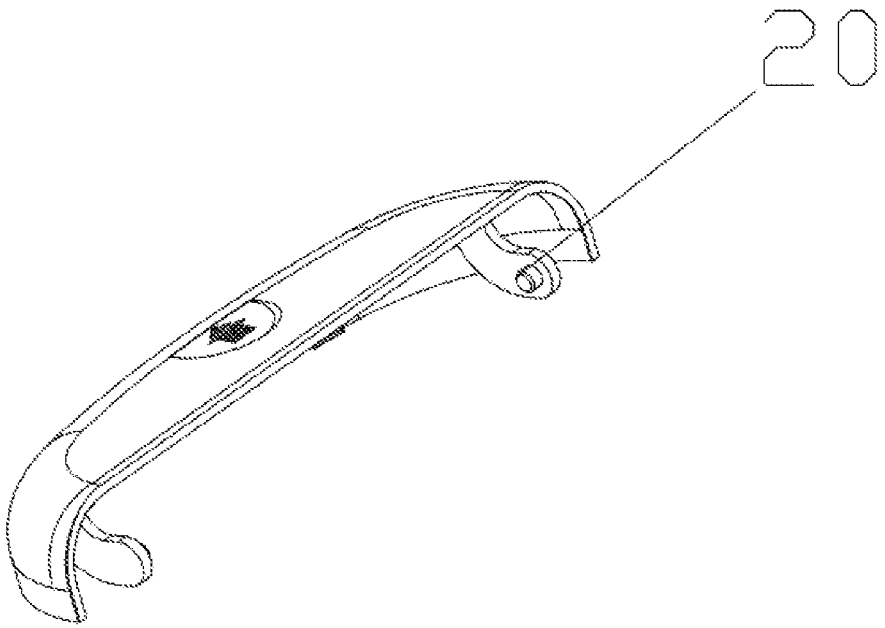
FIG. 5 is a schematic view of the structure of a cover plate of a squeezing and cleaning flat mop bucket in accordance with an embodiment of this disclosure.

With reference to FIGS. 1-5 for a squeezing and cleaning flat mop bucket in accordance with an embodiment of this disclosure, the squeezing and cleaning flat mop bucket comprises a bucket body 1, a bucket cover 2, and a pressing device 22, characterized in that the pressing device 22 is installed at an upper end of the bucket body 1, and the bucket cover 2 is covered onto and coupled to the bucket body 1, and the bucket body 1 has a cleaning chamber 3, a squeezing chamber 4 therein, and a partition 5 disposed between the cleaning chamber 3 and the squeezing chamber 4, and the pressing device 22 comprises a mount 6 having a cleaning chamber 3 formed thereon and configured to be corresponsive to a cleaning port 7 and a squeezing chamber 4 configured to be corresponsive to a squeezing port 8, and a first squeeze roller 23 is mounted onto the cleaning port 7, and a second squeeze roller 24 is mounted onto the squeezing port 8, and the first squeeze roller 23 has a plurality of bumps 10 formed thereon, and the squeezing chamber 4 has a pressure pump 14 of back suction function and a return pipe 15 installed therein, and the pressure pump 14 of back suction function is installed to the bottom of the squeezing chamber 4, and the return pipe 15 has an end coupled to the pressure pump 14 of back suction function and the other end disposed at the partition 5 and partially extended into the cleaning chamber 3. The cleaning port 7 of the mount 6 has a first positioning wheel 11, and the squeezing port 8 of the mount 6 has a second positioning wheel 12. The mount 6 further comprises a backwater board 13 disposed precisely under the second squeeze roller 24 and integrally coupled to the cleaning port 7 with a predetermined tilt angle. The mount 6 further comprises a first scraping blade structure 9 and a second scraping blade structure 25, and the first scraping blade structure 9 is disposed precisely under the first squeeze roller 23 and contacted and coupled to the backwater board 13, and the second scraping blade structure 25 is installed precisely under the second squeeze roller 24. The mount 6 has an elastic buckle 16 disposed at both sides of the mount 6 separately, and the bucket body 1 has an opening 17 formed at an upper end of the bucket body 1 and matched with the elastic buckle 16, and the mount 6 is coupled to the bucket body 1 through the mutual cooperation of the elastic buckle 16 and the opening 17. The mount 6 further comprises a handle 18 installed thereon and the bucket cover 2 has a cover plate 19 installed at an end of the bucket cover 2 and disposed at the cleaning chamber 3 and movably coupled to the mount 6. The cover plate 19 has a connecting member 20 installed on an inner side of the cover plate 19, and the mount 6 has a rail opening 21 formed thereon and matched with the connecting member 20, and the cover plate 19 is coupled to the mount 6 through a mutual cooperation of the connecting member 20 and the rail opening 21. The first scraping blade structure 9 comprises a first scraping blade 26 and a first torsion spring 27, and the first torsion spring 27 has an end sheathed on the first scraping blade 26 and the other end coupled to the mount 6. The second scraping blade structure 25 comprises a second scraping blade 28 and a second torsion spring 29, and the second torsion spring 29 has an end sheathed on the second scraping blade 28 and the other end coupled to the mount 6.

The squeezing and cleaning flat mop bucket of this embodiment adopts a special roller with a plurality of bumps 10. Compared with the mop bucket manufactured by other manufacturers simply relying on a scraper to scrap the mop fabric, the mop bucket of this disclosure has the features of high effectiveness and fast drying and cleaning effects. Meanwhile, the dry cleaning bucket has a pressure pump 14 of back-suction function, so that the dry cleaning bucket can be maintained cleaner and it is not necessary to clean the bucket body, and thus the cleaning of bucket can be skipped. The installation of the first positioning wheel 11 onto the cleaning port 7 and the second positioning wheel 12 onto the squeezing port 8 facilitates the flat mop to be positioned, cleaned, or dry cleaned in the cleaning chamber 3 and the squeezing chamber 4. The installation of the backwater board 13 onto the mount 6 facilitates recycling extra water produced during the process or squeezing and dewatering the flap mop into the cleaning chamber 3 at the front through the inclined backwater board 13 mounted onto the mount. A cover plate 19 is installed at an end of the bucket cover 2, disposed in the cleaning chamber 3, and movably coupled to the mount 6, so as to maintain the squeezing chamber 4 dry and prevent clear water from flowing into the squeezing chamber 4 when filling clear water into the cleaning chamber 3. The installation of the elastic buckle 16 onto the mount 6 facilitates installing or removing the flat mop bucket. The pressure pump 14 of back-suction function adopts a mechanical structure, so that when the mop fabric is squeezed, no extra operation is required since the mop plate presses a switch for pumping water. Meanwhile, a fully enclosed design gives an overall aesthetic appearance and saves the stacking space. The first scraping blade structure 9 is disposed precisely under the first squeeze roller 23 and contacted with the backwater board 13, and the second scraping blade structure 25 is disposed precisely under the second squeeze roller 24. A two-stage design is adopted at the cleaning port 7 to provide a more thorough cleaning, wherein the first squeeze roller 23 at the top is provided for squeezing, and the bumps 10 on the surface of the first squeeze roller 23 are provided for scraping garbage, and the first scraping blade 26 at the bottom is provided for re-scraping water and scraping dirt on the mop fabric. A two-stage design is adopted at the squeezing port 8 to squeeze the mop fabric drier and cleaner.

During installation, the first squeeze roller 23, second squeeze roller 24, first positioning wheel 11, second positioning wheel 12, first scraping blade 26 and second scraping blade 28 are installed onto the mount 6 first, and then the first scraping blade 26 and second scraping blade 28 are installed with the first torsion spring 27 and second torsion spring 29 respectively, and then the handle 18 is latched to both sides of the mount 6, and the pressure pump 14 of back suction function and return pipe 15 are placed into the squeezing chamber 4 while an end of the return pipe 15 is latched to an upper end of the partition 5 and partially extended into the cleaning chamber 3, and the mount 6 is buckled to an upper end of the bucket body 1 through the mutual cooperation of the elastic buckle 16 and the opening 17, and the bucket cover 2 is covered onto the bucket body 1. Finally, the cover plate 19 is slidably coupled to the mount 6 through the mutual cooperation of the connecting member 20 and the rail opening 21.

During operation, the cover plate 19 is opened, moved horizontally, and then lifted upwardly along the rail opening 21, and an appropriate amount of clear water is added into the cleaning chamber. The aforementioned amount of water should be less than the height of the partition 5 in the separated chambers, so that water can be overflown to maintain the rear of the interior of the bucket dry. After the clear water is added, the cover plate 19 is covered onto the bucket body 1, and the flat mop inserted vertically into the cleaning port 7 at the front and pulled up and down. The mechanically driven and rotated first squeeze roller 23 squeezes and scrap the fabric of the flat mop to achieve the effect of fully cleaning the mop fabric. Specifically, a two-stage design is adopted at the cleaning port 7 to provide a more thorough cleaning, and the first squeeze roller 23 at the top is provided for squeezing, and the bumps on the surface of the first squeeze roller 23 are provided for scrapping garbage, and the first scraping blade 26 at the bottom is provided for re-scraping water and scraping dirt from the mop fabric. After the mop is put into the squeezing port 8 at the rear of the mop bucket, the mop is pulled up and down. The action of the second squeeze roller 24 squeezes and dries the mop fabric of the flat mop. Extra water produced in the squeezing process is recycled into the cleaning chamber 3 at the front through the tilted backwater board 13 mounted onto the mount. In addition, extra water leaking into the squeezing chamber 4 presses the internal pressure pump 14 of back suction function at the time of pressing the flat mop, so that the extra water is pumped back into the cleaning chamber 3.

While this disclosure has been described by means of specific embodiments, numerous modifications and variations could be made thereto by those skilled in the art without departing from the scope and spirit of the invention set forth in the claims.

What is claimed is:

1. A squeezing and cleaning flat mop bucket, comprising a bucket body (1), a bucket cover (2) and a pressing device (22), characterized in that the pressing device (22) is installed at an upper end of the bucket body (1), and the bucket cover (2) covers the bucket body (1) and is coupled onto the bucket body (1), and the bucket body (1) has a cleaning chamber (3), a squeezing chamber (4) therein, and a partition (5) disposed between the cleaning chamber (3) and the squeezing chamber (4), and the pressing device (22) comprises a mount (6) having a cleaning chamber (3) formed thereon and configured to be corresponsive to a cleaning port (7) and a squeezing chamber (4) configured to be corresponsive to a squeezing port (8), and a first squeeze roller (23) is mounted onto the cleaning port (7), and a second squeeze roller (24) is mounted onto the squeezing port (8), and the first squeeze roller (23) has a plurality of bumps (10) formed thereon, and the squeezing chamber (4) has a pressure pump (14) of back suction function and a return pipe (15) installed therein, and the pressure pump (14) of back suction function is installed to the bottom of the squeezing chamber (4), and the return pipe (15) has an end coupled to the pressure pump (14) of back suction function and the other end disposed at the partition (5) and partially extended into the cleaning chamber (3).

2. The squeezing and cleaning flat mop bucket of claim 1, wherein the cleaning port (7) of the mount (6) has a first positioning wheel (11), and the squeezing port (8) of the mount (6) has a second positioning wheel (12).

3. The squeezing and cleaning flat mop bucket of claim 2, wherein the mount (6) further comprises a backwater board (13) disposed precisely under the second squeeze roller (24) and integrally coupled to the cleaning port (7) with a predetermined tilt angle.

4. The squeezing and cleaning flat mop bucket of claim 1, wherein the mount (6) further comprises a first scraping blade structure (9) and a second scraping blade structure (25), and the first scraping blade structure (9) is disposed precisely under the first squeeze roller (23) and contacted and coupled to the backwater board (13), and the second scraping blade structure (25) is installed precisely under the second squeeze roller (24).

5. The squeezing and cleaning flat mop bucket of claim 4, wherein the first scraping blade structure (9) comprises a first scraping blade (26) and a first torsion spring (27), and the first torsion spring (27) has an end sheathed on the first scraping blade (26) and the other end coupled to the mount (6).

6. The squeezing and cleaning flat mop bucket of claim 4, wherein the second scraping blade structure (25) comprises a second scraping blade (28) and a second torsion spring (29), and the second torsion spring (29) has an end sheathed on the second scraping blade (28) and the other end coupled to the mount (6).

7. The squeezing and cleaning flat mop bucket of claim 1, wherein the mount (6) has an elastic buckle (16) disposed at both sides of the mount (6) separately, and the bucket body (1) has an opening (17) formed at an upper end of the bucket body (1) and matched with the elastic buckle (16), and the mount (6) is coupled to the bucket body (1) through the mutual cooperation of the elastic buckle (16) and the opening (17).

8. The squeezing and cleaning flat mop bucket of claim 7, wherein the mount (6) further comprises a handle (18) installed thereon.

9. The squeezing and cleaning flat mop bucket of claim 1, wherein the bucket cover (2) has a cover plate (19) installed at an end of the bucket cover (2) and disposed at the cleaning chamber (3) and movably coupled to the mount (6).

10. The squeezing and cleaning flat mop bucket of claim 9, wherein the cover plate (19) has a connecting member (20) installed on an inner side of the cover plate (19), and the mount (6) has a rail opening (21) formed thereon and matched with the connecting member (20), and the cover plate (19) is coupled to the mount (6) through a mutual cooperation of the connecting member (20) and the rail opening (21).

* * * * *